US005227237A

United States Patent [19]

Saruyama et al.

[11] Patent Number: 5,227,237

[45] Date of Patent: Jul. 13, 1993

[54] NONCIRCULAR CROSS-SECTION CARBON FIBER, PROCESS FOR PRODUCING THE SAME AND COMPOSITE OF THE CARBON FIBER WITH RESIN

[75] Inventors: Hideo Saruyama, Ehime; Akira Okuda, Iyo, both of Japan

[73] Assignee: Toray Industries, Inc., Tokyo, Japan

[21] Appl. No.: 575,709

[22] Filed: Aug. 31, 1990

[30] Foreign Application Priority Data

Sep. 5, 1989 [JP] Japan ..... 1-229578

[51] Int. Cl.[5] ..... B32B 9/00; D01F 9/14

[52] U.S. Cl. ..... 428/367; 264/29.2; 264/29.5; 423/447.1; 423/447.2; 423/447.4; 423/447.6; 428/323; 428/408

[58] Field of Search ..... 423/447.1, 447.2, 447.4, 423/447.6; 264/29.2, 29.5; 428/367, 323, 408

[56] References Cited

U.S. PATENT DOCUMENTS

| | | | |
|---|---|---|---|
| Re. 30,414 | 10/1980 | Kinoshita | 423/447.4 |
| 3,600,491 | 8/1971 | Shimoda et al. | 264/177 F |
| 4,535,027 | 8/1985 | Kobashi et al. | 423/447.1 |
| 4,628,001 | 12/1986 | Sasaki et al. | 423/447.1 |
| 4,695,415 | 9/1987 | Setsui et al. | 264/29.2 |
| 4,935,180 | 6/1990 | Daumit et al. | 264/29.2 |

FOREIGN PATENT DOCUMENTS

| | | | |
|---|---|---|---|
| 219964 | 4/1987 | European Pat. Off. . | |
| 168126 | 9/1984 | Japan . | |
| 3021916 | 1/1988 | Japan | 264/29.2 |

*Primary Examiner*—Michael Lewis
*Assistant Examiner*—Stephen G. Kalinchak
*Attorney, Agent, or Firm*—Armstrong, Westerman, Hattori, Mcleland & Naughton

[57] ABSTRACT

A noncircular cross-section carbon fiber wherein the cross-section is a noncircular one having at least one plane of symmetry passing the centroid and having an angle of rotational symmetry, $\theta$, defined by $\theta=360°/n$, in which n is an integer of 1 to 10; wherein the internal structure has no lamellar structure and the fiber has a substantially uniform crystalline structure; and wherein the fiber surface has a surface smoothness S of 1.16 or below and the tensile strength and the tensile modulus of the fiber in the form of a resin-impregnated strand is 300 kg/mm$^2$ or above and 20 ton/mm$^2$ or above, respectively; a process for producing such carbon fiber; and a composite of such carbon fiber with a resin.

10 Claims, 3 Drawing Sheets

NONCIRCULAR CROSS-SECTION CARBON FIBER, PROCESS FOR PRODUCING THE SAME AND COMPOSITE OF THE CARBON FIBER WITH RESIN

BACKGROUND OF THE INVENTION

This invention relates to a noncircular cross-section carbon fiber, a process for producing the carbon fiber and a composite of the carbon fiber with a resin, and more particularly, a noncircular cross-section carbon fiber which can give an excellent reinforcing effect to a composite of the carbon fiber with a resin, a process for producing such carbon fiber, and a composite of such carbon fiber with a resin.

Because carbon fiber is excellent in both specific strength and specific modulus when compared with other fibers, it is extensively used in the industry as a reinforcing fiber for a composite with resin by virtue of its excellent mechanical properties. Recently, the usefulness of a carbon fiber composite is increasing, and it is demanded that the performances of carbon fiber for especially sports, aircraft and aerospace uses be further heightened.

To meet such a demand for heightening the performances of carbon fiber, a marked progress was made in the properties of carbon fiber itself such as strength, modulus, etc., of a resin-impregnated strand. Although the performances of carbon fiber itself were thus improved, the properties of a composite in which such carbon fiber is actually used cannot yet be satisfactorily improved. That is, the availability of the strength of carbon fiber in a composite and basic properties of a composite such as interlaminar shear strength (ILSS), compressive strength and bending strength are not sufficiently improved. Although various proposals of means for improving the basic properties of a composite, such as one comprising improving the surface properties of carbon fiber by electrolytic surface treatment, one comprising improving the properties of the matrix resin used and one comprising devising the arrangement of the carbon fiber constituting a composite have been made, no satisfactory results have been attained for the present.

Against such prior art technical backgrounds, the inventors of this invention have comprehensively studied means for improving the basic properties of a composite of carbon fiber with resin, whereupon they have found out that, as will be described in the detailed description of the invention hereinbelow, it is very effective to use a carbon fiber having a nonspherical section as well as to improve the internal structure of carbon fiber itself.

Such techniques of giving a noncircular section to carbon fiber are heretofore well known concerning pitch-derived carbon fiber as described in for example Japanese patent application Kokai publications No. 61-6313, No. 62-117821, No. 62-231024 and No. 62-131034. However, the non-circular cross-sections proposed by these disclosed techniques are those intended as means for improving a pitch-derived carbon fiber whose strength and modulus are low due to the heterogeneous crystalline structure as a lamellar structure inherent therein. Although the heterogeneous crystalline structure is decreased in amount, it still remains inside carbon fiber, so that the techniques are not those for improving the basic properties of a composite.

Further, an example of forming a nonspherical cross-section carbon fiber from a noncircular cross-section polyacrylonitrile (PAN) fiber obtained by the melt spinning process as a precursor is described in the Preprints of the 20th International SAMPE Technical Conference (1988). In order to make PAN melt-spinnable, one is obliged to adopt either means comprising adding a plasticizer to the polymer or means comprising the use of a low-MW PAN polymer, so that it is difficult in either case to give a precursor of a high degree of orientation. Therefore, it is almost impossible to improve the mechanical properties of a carbon fiber itself, even when this precursor is made into carbon fiber, and to improve the basic properties of a composite by using this carbon fiber. Especially in the means comprising adding a plasticizer to the polymer, this plasticizer functions as an impurity to adversely affect the properties of a carbon fiber, so that it is almost impossible to attain high mechanical properties.

Further, a polygonal cross-section carbon fiber produced from a polygonal cross-section PAN fiber as a precursor obtained by the wet spinning process is disclosed in Japanese patent application Kokai publication No. 57-42927. However, the polygonal cross-section carbon fiber thus produced cannot give a laminate having an increased availability of the strength of the fiber, so that it has a drawback that the basic properties of a composite such as tensile strength and compressive strength cannot be sufficiently increased.

SUMMARY OF THE INVENTION

An object of this invention is to provide a non-circular cross-section carbon fiber having an increased effect of reinforcing a composite and thereby being capable of further improving the basic properties of a composite, such as ILSS, compressive strength and bending strength.

Another object of this invention is to provide a process for producing a noncircular cross-section carbon fiber thus having an improved effect of reinforcing a composite.

Still another object of the invention is to provide a carbon fiber composite having further improved basic properties such as ILSS, compressive strength and bending strength.

In order to accomplish the above objects, the non-circular cross-section carbon fiber of this invention is characterized in that the cross-section is a noncircular one having at least one plane of symmetry passing its centroid and having an angle $\theta$ of rotational symmetry as defined by $\theta=360°/n$, wherein n is an integer of 1 to 10, that the internal structure has no lamellar structure having a substantially homogeneous crystalline structure, that the surface smoothness S of the fiber is 1.16 or below, and that the tensile strength and the tensile modulus are 300 kg/mm$^2$ or above and 20 ton/mm$^2$ or above, respectively, when measured in the form of a resin-impregnated strand.

According to this invention, the noncircular cross-section carbon fiber having the above-mentioned characteristics can be produced from a noncircular cross-section precursor fiber produced by dry-jet wet spinning an acrylonitrile copolymer (hereinafter referred to as PAN polymer), which spinning will be described hereinafter, oxidizing the precursor in an oxidizing atmosphere and carbonizing the oxidized precursor in an inert atmosphere. The above-mentioned precursor can be produced by the so-called dry-jet wet spinning process, which comprises spinning a spinning dope comprising a PAN polymer containing at least 95 mol % of acrylonitrile and a solvent therefor through a spinneret having noncircular cross-section holes temporarily into air or an inert gas atmosphere, coaguloating the spun fiber by immediately immersing it in a coagulation bath comprising the above-mentioned solvent and a coagulant, washing the fiber with water and drawing it. Here the precursor is produced so that the cross-section may be a noncircular one having at least one plane of symmetry passing its centroid and having an angle $\theta$ of rotational symmetry as defined by $\theta=360°/n$, wherein n is an integer of 1 to 10.

The noncircular cross-section carbon fiber obtained in this way can give a resin composite of an improved availability of the strength of the fiber because the excellent mechanical properties inherent in the carbon fiber can be reflected in the composite. Therefore, it is possible to improve the basic properties of the composite such as bending strength, compressive strength and ILSS.

DETAILED DESCRIPTION OF THE INVENTION

The carbon fiber of this invention is such a one in which the cross-section is a noncircular one having a certain symmetry. The noncircular cross-section having a certain symmetry refers to a cross-section specified in that it has at least one plane of symmetry passing its centroid and has an angle $\theta$ of rotational symmetry as defined by $\theta=360°/n$, wherein n is an integer of 1 to 10. Because the carbon fiber has such a noncircular cross-section, it is possible that when the fiber is used in a composite, its area of contact with the matrix resin increases to thereby increase the bonding force and that the basic properties of a composite are markedly improved. Further, the noncircular cross-section carbon fiber can contribute much to the improved bending strength of a composite because it has a large geometrical moment of inertia as compared with a circular cross-section carbon fiber. Because this noncircular cross-section is symmetrical, the distribution of a stress in the direction of the section against a strain in the longitudinal direction of a composite (in the lengthwise direction of the fiber) can be made uniform. As a result of combination of these actions, the excellent mechanical properties of the carbon fiber can be reflected on the composite.

Further, because the internal structure of the carbon fiber is a homogeneous crystalline one free of a lamellar structure, the effect of reflecting the properties of the carbon fiber on the composite can be further improved, and it can be further heightened by a surface smoothness of $S \leqq 1.16$ of the fiber, in other words, a high smoothness free of fine irregularities, because such surface smoothness can delocalize stress on fiber surface.

This effect of reflecting the properties of the carbon fiber on the composite can be made more marked by setting the tensile strength and tensile modulus of the carbon fiber in the form of a resin-impregnated strand to 300 kg/mm$^2$ or above, desirably 320 kg/mm$^2$ or above, and 20 ton/mm$^2$ or above, desirably 22 ton/mm$^2$ or above, respectively.

The state of rotational symmetry of the cross-section of the fiber used in this invention means that quite the same figure appears repeatedly when it is turned by an angle $\theta$ about the centroid, and the angle $\theta$ of rotation at that time is referred to as the angle of rotational symmetry. Further, the plane of symmetry means a boundary plane along which the right-hand and left-hand figures are the same when a mirror operation or reflection is effected in the cross-section of a fiber.

Figure 1A:
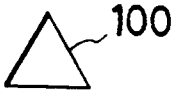
FIGS. 1A to 1F are each a plan view of a hole of a spinneret for spinning a precursor used in the process of the carbon fiber of this invention.
Figure 1B:
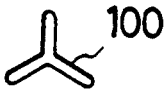
Figure 1C:
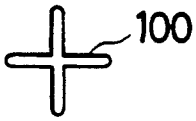
Figure 1D:
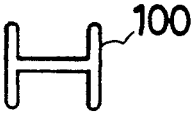
Figure 1E:
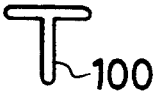
Figure 1F:
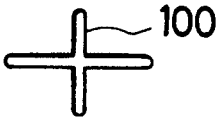
Figure 2A:
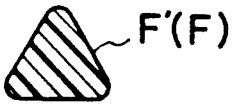
FIGS. 2A to 2F are each a transverse sectional view of a fiber obtained by spinning through the hole of FIGS. 1A to 1F by the dry-jet wet spinning process and/or a carbon fiber after being calcined.
Figure 2B:
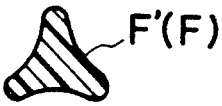
Figure 2C:
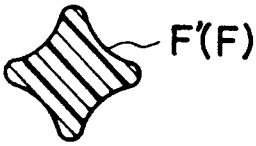
Figure 2D:
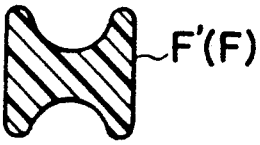
Figure 2E:
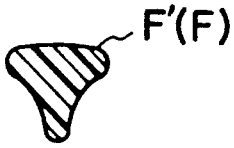
Figure 2F:
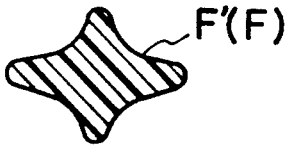

In the case of a fiber having a regular polygonal or regular multifoliate cross-section, the value of n in the definition of the angle $\theta$ of rotational symmetry is equal to the number of corners, and so is the number of planes of symmetry. Thus in the case of an equilateral triangle of FIG. 2A or a regular trifoliate figure of FIG. 2B, the value of n is 3, and so is the number of planes of symmetry. On the contrary, in the case of a fiber having an irregular polygonal or irregular polyfoliate cross-section, the value of n and the number of planes of symmetry have values varying according to the irregularity. For example, in the case of an isoscale triangle, an elongated pentagon, a heart-shaped figure, a deformed trifoliate figure, etc., the value of n is 1, and so is the number of planes of symmetry. Further, in the case of a rectangle, an elongated hexagon, a dog bone figure, a cocoon figure, an H-shaped figure of FIG. 2D, a deformed tetrafoliate figure of FIG. 2F, etc., the value of n is 2, and so is the number of planes of symmetry.

It is necessary in this invention that the upper limit of n which defines the angle $\theta$ of rotational symmetry be 10, desirably 5. This is because when n is excessively large, the cross-section of the fiber approximates a circle to diminish the effect of the noncircular cross-section of this invention.

Especially, a carbon fiber in the range of $n=2$ to 5 can be more homogeneously dispersed in a matrix resin.

Figure 3:
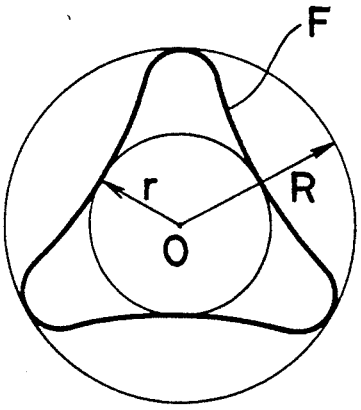
FIG. 3 is a schematic representation for illustrating the definition of a degree of deformation of carbon fiber.

Further, it is desirable that the noncircular cross-section of the carbon fiber have a degree of deformation within a specified range in addition to the above-mentioned symmetry. For example, an elongated flattened section which is extremely different from a circular cross-section prevents the carbon fiber from being homogeneously dispersed in resin when it is made into a composite, thus giving lowered basic properties of the composite. In the trifoliate section of a carbon fiber F shown in FIG. 3, when the ratio of the radius R of a circumscribed circle of the cross-section to the radius r of the inscribed circle thereof is defined as a degree D of deformation, it is suitable that this degree D is within a range of desirably 1.1 to 7.0, more desirably 1.2 to 6.0, still more desirably 1.3 to 5.0.

Figure 4A:
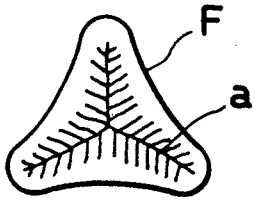
FIGS. 4A and 4B are each a schematic representation of the lamellar structure of a cross-section of carbon fiber.
Figure 4B:
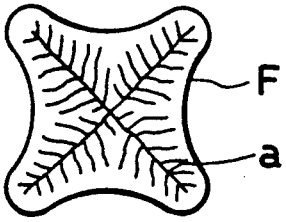

As mentioned above, the carbon fiber of this invention must have an internal structure which is a homogeneous crystalline one free of a lamellar structure in order to improve the basic properties of a laminate made therefrom. As shown in FIGS. 4A and 4B, the lamellar structure is a leaf-like crystalline orientation a extending radially along the cross-section of a carbon fiber. The presence of this lamellar structure a can be easily confirmed by observing the fracture surface of a carbon fiber with a scanning electron microscope (SEM). The formation of such a lamellar structure can be prevented by using a PAN precursor produced by dry-jet wet spinning process employed in the production process of this invention.

Further, the carbon fiber of this invention is characterized by having a surface smoothness S of 1.16 or below, being free from fine irregularities on the fiber surface and having a very high smoothness. If the fiber has fine irregularities on the surface, the irregularities are apt to act as fracture initiating points because of the concentration of stress on them, which causes decreases in the compressive strength and the bending strength of especially a composite made therefrom. The above surface smoothness S is defined as a square of a ratio $l/l_0$, wherein l is the perimeter of the cross-section as determined with an image analyzer from a photograph prepared by taking a photograph of the cross-section of a carbon fiber at 7,500×magnification with a scanning electron microscope and further photographically enlarging the photography four-fold (an enlarged photograph of 7,500×4), and $l_0$ is the circumference of the circumscribed circle of this enlarged cross-section. That is, it is a value determined according to the equation of $S=(l/l_0)^2$.

Such a carbon fiber of a surface smoothness $S \leqq 1.16$ can be easily produced from a PAN precursor produced by the dry-jet wet spinning process. Although such a high surface smoothness can be attained also by the dry spinning or melt spinning process, it is difficult to properly control the above-mentioned degree D of deformation of the cross-section of the fiber because a precursor produced by the dry spinning process has a large volume shrinkage caused by the evaporation of the solvent from the spinning dope, so that there is a tendency that the cross-section of the fiber is markedly different from the shape of the noncircular cross-section hole of a spinneret. Further, as described above, it is impossible to produce a good carbon fiber by the melt spinning process.

The above described noncircular cross-section carbon fiber of this invention can be produced from a PAN precursor produced by the dry-jet wet spinning process and subjecting this precursor to an oxidation step and a carbonization step. The dry-jet wet spinning process herein mentioned is a process comprising spinning temporarily a dope through the holes of a spinneret into air or an inert atmosphere and immediately coagulating the extrudate by immersing in a coagulation bath. The process for producing a carbon fiber will now be described in more detail.

The precursor of the acrylic fiber used in the production of the carbon fiber in this invention is produced from a PAN polymer prepared from 95 mol % or above, desirably 98 mol % or above, of acrylonitrile (hereinafter referred to as AN) and desirably 5 mol % or below, particularly desirably 2 mol % or below, of a vinyl compound (hereinafter referred to as vinyl monomer) having copolymerizability with AN and being capable of accelerating the oxidation.

Examples of the vinyl monomer promoting the oxidation include acrylic acid, methacrylic acid, itaconic acid, and alkali metal salts and ammonium salts thereof, α-(1-hydroxylethyl)acrylonitrile, and hydroxylated esters of acrylic acid. Further, in order to improve the spinnability, yarn forming property, etc. of a PAN polymer, it is also possible to copolymerize 5 mol % or below, desirably 2 mol % or below (in terms of the total amount of the comonomers) of a third component such as lower alkyl esters of the above-mentioned acrylic acid and methacrylic acid, allylsulfonic acid, methallylsufonic acid, styrenesulfonic acid, and alkali metal salts thereof, vinyl acetate or vinyl chloride in addition to these vinyl monomers promoting the oxidation.

Such PAN polymers can be prepared by for example emulsion, suspension, bulk or solution polymerization.

To produce acrylic fibers from these PAN polymers, polymer solutions comprising solvents such as dimethylformamide, dimethyl sulfoxide, nitric acid, an aqueous sodium rhodanate solution and an aqueous zinc chloride solution are used as the spinning dope. It is necessary that the hole of a spinneret used for spinning these dopes by the dry-jet wet spinning process should be a noncircular one having symmetry like that of the cross-section of the carbon fiber to be produced. This noncircular figure must be a one having an angle $\theta$ of rotational symmetry as defined by $\theta=360°/n$, wherein n is an integer of 1 to 10, and having at least one plane of symmetry passing its centroid.

Examples of the shape of the hole are those represented by the numeral 100 in FIGS. 1A to 1F. The cross-section of the fiber obtained by spinning through any of the holes 100 of FIGS. 1A to 1F will have any of the shapes represented by F' in FIGS. 2A to 2F. These cross-sections, even when the fibers are converted into carbon fibers F by calcination, are kept without being substantially changed. Therefore, it is suitable that the degree D of deformation of the cross-section of the fiber to be used as a precursor, like the above-mentioned carbon fiber, is within a range of desirably 1.1 to 7.0, more desirably 1.2 to 6.0, still more desirably 1.3 to 5.0.

The dope extruded from the hole is temporarily spun into air or an inert atmosphere and immediately immersed in a coagulation bath. The coagulation bath is constituted of a solvent for PAN and a coagulant. Suitable examples of the coagulant include water, methanol and acetone, and especially water is preferable from the viewpoints of safety and recoverability.

The coagulated fiber is washed with water, drawn in hot water and given 0.2 to 1.5 wt % of a process lubricant per unit weight of the dry fiber.

It is desirable to use a silicone compound or a modified silicone compound effective especially in preventing single-filaments from being fused with each other during calcination as a component of the lubricant.

After being given the process lubricant, the fiber is dried and densified to give a densified fiber. This fiber is then optionally subjected to a secondary drawing in for example steam. The single-filament fineness of the precursor obtained in this way is a very important factor for determining the properties of the noncircular cross-section carbon fiber to be obtained. In this invention, it is desirably 0.1 to 2.5 denier, more desirably 0.2 to 2.0 denier, still more desirably 0.3 to 1.5 denier. When it is below 0.1 denier, breaking of single-filament frequently occurs. When it is above 2.5 denier, it is difficult to calcine inner and outer layers of the single-filament uniformly and to obtain a carbon fiber of excellent properties. Therefore, it is desirable in order to uniformly calcine the fiber to adopt a fineness of 2.5 denier or below.

The precursor of the acrylic fiber spun in this way is converted into carbon fiber by calcination. The calcination of the precursor consists of an oxidation step, a carbonization step and optionally a graphitization step. Although the conditions of these steps are not particularly limited, it is desirable to adopt conditions under which structural defects such as voids are difficultly formed inside the fiber.

For example, the condition of the step of carbonization in an inert atmosphere such as nitrogen is desirably such that the rate of temperature rise in the temperature ranges of 300° to 700° C. and 1000° to 1200° C. is 1000° C./min or below, desirably 500° C./min or below. Further, it is also possible to produce a graphitized fiber by graphitization in an inert atmosphere at for example 1400° C. to 3000° C.

It is desirable to subject the noncircular cross-section carbon fiber obtained in this way to electrolytic oxidation in an electrolytic bath comprising an aqueous sulfuric acid solution or an aqueous nitric acid solution, or to oxidation in the vapor or liquid phase. By such treatment, the affinity for the resin used in a composite and the adhesion thereto can be desirably improved.

The carbon fiber obtained by the above-mentioned process of this invention is a one having a cross-section which is a noncircular one having symmetry and having a lamellar structure-free substantially uniform crystalline structure. Further, the strength and the modulus inherent in the carbon fiber lead to excellent properties such as the tensile strength and the tensile modulus of the fiber in the form of a composite of 300 kg/mm$^2$ or above and 20 ton/mm$^2$ or above, respectively. Therefore, by forming this carbon fiber into a composite, the basic properties of the obtained composite, such as ILSS, compressive strength and bending strength can be improved. The matrix resins to be used in the carbon fiber composites of this invention may be any of thermo-setting and thermoplastic resins, and examples thereof include epoxy, phenolic, polyimide, polyester and polyamide resins. The carbon fiber composites can be produced by first processing the above-mentioned carbon fiber into prepregs, sheet molding compounds (SMC) or chopped fibers and molding the products by for example hand lay-up, autoclaving or protrusion.

This invention will now be described in more detail with reference to Examples thereof. The physical property values used in the specification and the Examples are those measured by the methods described below.

STRENGTH AND MODULUS OF RESIN-IMPREGNATED STRAND

These values are obtained by subjecting a sample prepared by impregnating a carbon fiber with a thermosetting resin of the following composition and curing the resin under curing conditions of 130° C. and 30 min to the testing method for resin-impregnated strand as specified in JIS R 7601.

| | |
|---|---|
| "Bakelite" ERL-4221 boron trifluoride monoethylamine (BF-3MEA) | 100 parts |
| acetone | 3 parts |
| | 4 parts |

PROPERTIES OF COMPOSITE a. Tensile strength, Bending strength and ILSS

A mold was filled with a carbon fiber wound around a metallic frame in a volume fraction (Vf) of carbon fiber of 60%, and a resin having the following composition was poured into the mold and vacuum-deaerated by heating under the following molding conditions. After being deaerated, the resin was cured by heating with a press under an applied pressure to prepare test pieces. The test pieces were tested on an "Instron" tester. The measured value was represented in terms of a value when Vf was 60%.

Resin:

| | |
|---|---|
| epoxy resin EP828 (a product of Petrochemicals K.K.) | 100 parts |
| boron trifluoride monoethylamine | 0.5 parts |

Molding Conditions:

| |
|---|
| deaeration: vacuum (≦10 mmHg), 70° C. for 2 hr |
| molding: pressing pressure of 50 kg/cm$^2$, 170° C. for 1 hr |
| postcure: 170° C. for 2 hr after the test piece was withdrawn from the mold |
| test piece for tensile strength: 6 mm wide, 1.6 mm thick |
| test pieces for bending strength and ILSS: 6 mm wide, 2.5 mm thick |

Measurement:

Tensile strength: The length of the test piece was 150 mm, and 45 mm-long aluminum tabs were bonded to its both ends. Concave cuttings of a radius of 75 mm were formed on the central areas on both sides of the test piece in the direction of thickness, and the cut test piece was used in the measurement. Further, the sectional area was determined by measuring the thickness and width of the thinnest part of the concave part.

Bending strength: The length of the test piece was 150 mm, and the strength of this test piece was measured with a three-point bending test fixture.

ILSS: The length of the test piece was 18 mm, and the ILSS of this test piece was measured with a three-point bending test fixture by using a supporting span four times as large as the thickness of the test piece.

b. Compressive Strength (Strength at compression)

A prepreg sheet was produced by unidirectionally arranging carbon fibers on a resin film produced by coating a silicone resin-coated paper with #3620 resin (a product of Toray Industries, Inc., comprising an epoxy compound and a diamine), laying the same resin film as above on the carbon fibers and infiltrating the resin among the carbon fibers by using a press roll. Such prepreg sheets were laminated in such a manner that the fiber axes of the sheets might be the same, and autoclaved for 2 hours under a pressure of 6 kg/cm$^2$ to cure the resin to make a flat plate of thickness of about 1 mm. This flat plate was cut with a diamond cutter to prepare a test piece which was 80 mm long in the direction of the fiber axis and 12 mm wide in the direction perpendicular to the fiber axis. A test piece for the measurement of the compressive strength was prepared by bonding tabs of a thickness of about 1 mm comprising a composite of carbon fibers and an epoxy resin to both sides of each end of this test piece so as to leave a 5 mm unbonded middle part.

OBSERVATION OF THE CROSS-SECTION OF CARBON FIBER

SEM was used here. A fracture of a carbon fiber sample was metallized with gold to observe the fracture by taking an SEM photograph at a 10,000 × magnification under an accelerating voltage of 25 kV.

EXAMPLES 1 TO 4 AND COMPARATIVE EXAMPLE 1

Ammonia was blown into a dimethyl sulfoxide (DMSO) solution of an AN copolymer of an intrinsic viscosity [η] of 1.80 comprising 99.5 mol % of AN and 0.5 mol % of itaconic acid to modify the copolymer by substituting ammonium groups for the carboxyl terminals of the copolymer to thereby prepare a DMSO solution having a concentration of the modified copolymer of 20 wt %, and this solution was used as a spinning dope.

This spinning dope was spun by the dry-jet wet spinning process in such a way that the dope was spun through each of spinnerets having 1500 holes each having a slit width of 0.03 mm and being Y-, +-, H- or T-shaped temporarily into air in a 3 mm-wide space, and then immersed in a 30% aqueous DMSO solution at 10° C. to form a coagulated fiber (Examples 1 to 4).

For comparison, a coagulated fiber was formed also by spinning the above-mentioned spinning dope by the dry-jet wet spinning process through a conventional spinneret having circular cross-section holes of a diameter of 0.06 mm (Comparative Example 1).

Each coagulated fiber was washed with water and subjected to four-stage drawing in hot water to give a bath-drawn fiber. The overall draw ratio was 3.5, and the maximum temperature of the drawing bath was 70° C. The bath-drawn fiber was given a lubricant based on a modified silicone compound and dried with a heating roll at 130° C. The densified fiber was further drawn at a ratio of 2.5 in high-pressure steam to give acrylic fiber filaments of a single-filament fineness of 1.0 denier and a total fineness of 1500 denier.

The obtained filament was oxidized while drawing it at a draw ratio of 1.05 in air at 240° to 260° C., and was converted into a carbon fiber by calcinating it in a carbonization furnace under a nitrogen atmosphere at a maximum temperature of 1400° C., a rate of temperature rise of 250° C./min in a temperature range of 300° to 700° C., and a rate of temperature rise of 400° C./min in a temperature range of 1000° to 1200° C. The obtained carbon fiber was further graphitized in a Tammann furnace at 1600° to 3000° C.

The carbon fiber was optionally anodized in an electric bath containing an aqueous sulfuric acid or nitric acid solution as an electrolyte in order to improve the affinity for resin.

A single-filament of the obtained noncircular cross-section carbon fiber was broken in water, and the fracture was observed with SEM, whereupon a leaf-like lamellar structure was observed in none of them.

Table 1 gives the properties of resin-impregnated strands and composites of the carbon fibers obtained in this way.

Table 1 shows that the noncircular cross-section carbon fibers such as Y-, +-, H- and T-section fibers of Examples 1 to 4 show composite properties exceeding those of the circular cross-section carbon fiber of Comparative Example 1.

Namely, the availability of the strength of the circular cross-section carbon fiber having a resin-impregnated strand strength of 530 kg/mm² in Comparative Example 1 was about 46% because the fiber showed a tensile strength of 245 kg/mm² as measured in the form of a composite. On the contrary, the availability of the strength of carbon fiber in Example 1 was about 50% because the Y cross-section carbon fiber having a resin-impregnated strand strength of 540 kg/mm² showed a tensile strength of 273 kg/mm² as measured in the form of a composite; the availability in Example 2 was about 50% because the + cross-section carbon fiber having a resin-impregnated strand strength of 535 kg/mm² showed a tensile strength of 270 kg/mm² as measured in the form of a composite; the availability in Example 3 was about 52% because the H cross-section carbon fiber having a resin-impregnated strand strength of 520 kg/mm² showed a tensile strength of 270 kg/mm² as measured in the form of a composite; and the availability in Example 4 was about 50% because the T cross-section carbon fiber of Example 4 having a resin-impregnated strand strength of 535 kg/mm² showed a tensile strength of 270 kg/mm² as measured in the form of a composite. Thus all of the availabilities of the strength were higher than that of Comparative Example 1.

TABLE 1

| | | | | strand properties | | composite properties | | | |
|---|---|---|---|---|---|---|---|---|---|
| | cross section | angle of rotational symmetry θ (°) | surface smoothness S | strength (kg/mm²) | modulus (ton/mm²) | tensile strength (kg/mm²) | bending strength (kg/mm²) | compressive strength (kg/mm²) | ILSS (kg/mm²) |
| Comparative Example 1 | circular | — | 1.08 | 530 | 23.5 | 245 | 145 | 175 | 8.0 |
| Example 1 | Y | 120 | 1.09 | 540 | 24.5 | 273 | 172 | 205 | 8.4 |
| Example 2 | + | 90 | 1.08 | 535 | 25.0 | 270 | 165 | 198 | 8.6 |
| Example 3 | H | 100 | 1.10 | 520 | 24.5 | 270 | 168 | 200 | 8.5 |
| Example 4 | T | 360 | 1.09 | 535 | 24.5 | 270 | 165 | 200 | 8.4 |

COMPARATIVE EXAMPLES 2 AND 3:

Carbon fibers were produced under the same conditions as those of Example 1 and Comparative Example 1 except that in the cases of the spinneret having Y-shaped holes of Example 1 and the spinneret having circular holes of Comparative Example 1, the coagulation bath was a 55% aqueous DMSO solution at 55° C., the above spinnerets were dipped in the coagulation bath for executing the wet spinning, the drawing in hot water was conducted in four stages, the overall draw ratio was 3, the maximum temperature of the drawing bath was 95° C., and the draw ratio in the high-pressure steam was 3.3.

Although none of the obtained carbon fibers had a lamellar structure in the cross-section, the surface smoothness S of the fiber surface was large in all cases and had fine irregularities. The properties of the resin-impregnated strands and the composites were given in Table 2, showing that the properties of the composites were not improved so markedly.

TABLE 2

| | cross section | angle of rotational symmetry θ (°) | surface smoothness S | strand properties: strength (kg/mm²) | strand properties: modulus (ton/mm²) | composite properties: tensile strength (kg/mm²) | composite properties: bending strength (kg/mm²) | composite properties: compressive strength (kg/mm²) |
|---|---|---|---|---|---|---|---|---|
| Comparative Example 2 | Y | 120 | 1.22 | 420 | 25.5 | 176 | 160 | 165 |
| Comparative Example 3 | circular | — | 1.20 | 400 | 24.0 | 168 | 140 | 155 |

EXAMPLE 5 AND COMPARATIVE EXAMPLES 4 AND 5

TABLE 3

| | cross section | angle of rotational symmetry θ (°) | surface smoothness S | strand properties: strength (kg/mm²) | strand properties: modulus (ton/mm²) | composite properties: tensile strength (kg/mm²) | composite properties: bending strength (kg/mm²) | composite properties: compressive strength (kg/mm²) |
|---|---|---|---|---|---|---|---|---|
| Example 5 | regular decagonal | 36 | 1.09 | 460 | 23.5 | 210 | 155 | 182 |
| Comparative Example 4 | regular dodecagonal | 30 | 1.09 | 460 | 23.5 | 190 | 145 | 170 |
| Comparative Example 5 | circular | — | 1.09 | 450 | 23.0 | 195 | 145 | 166 |

A noncircular cross-section carbon fiber was produced under the same conditions as those of Example 1 except that a spinneret having 100 holes each of which was composed of a central circular pore of a diameter of 0.05 mm and 10 slits of a width of 0.02 mm and a length of 0.06 mm equidistantly and radially arranged from the positions 0.05 mm distant from the center of the pore was used, the air gap between the spinneret and the coagulating bath was 1.5 mm, the single-filament fineness was 1.5 denier, the total fineness was 150 denier, and four multifilaments were combined for oxidation for a period of 1.5 times as long (Example 5).

For comparison, a noncircular cross-section carbon fiber was produced under the same conditions as those of Example 5 except that 12 slits were equidistantly and radially arranged (Comparative Example 4).

Furthermore, a circular cross-section carbon fiber was produced under the same conditions as those of Example 5 except that a spinneret having 100 circular holes of a diameter of 0.12 mm was used (Comparative Example 5).

A lamellar structure was confirmed in none of the fractures of the obtained carbon fibers, and none of the fiber surfaces had fine irregularities. The properties of the resin-impregnated strands and the composites of these carbon fibers are given in Table 3, showing that the composite properties of the regular dodecagonal cross-section carbon fiber of Comparative Example 4 were not high as compared with those of the regular decagonal cross-section carbon fiber of Example 5 and were comparable to those of the circular cross-section carbon fiber of Comparative Example 5.

EXAMPLE 6 AND COMPARATIVE EXAMPLE 6

Figure 5:
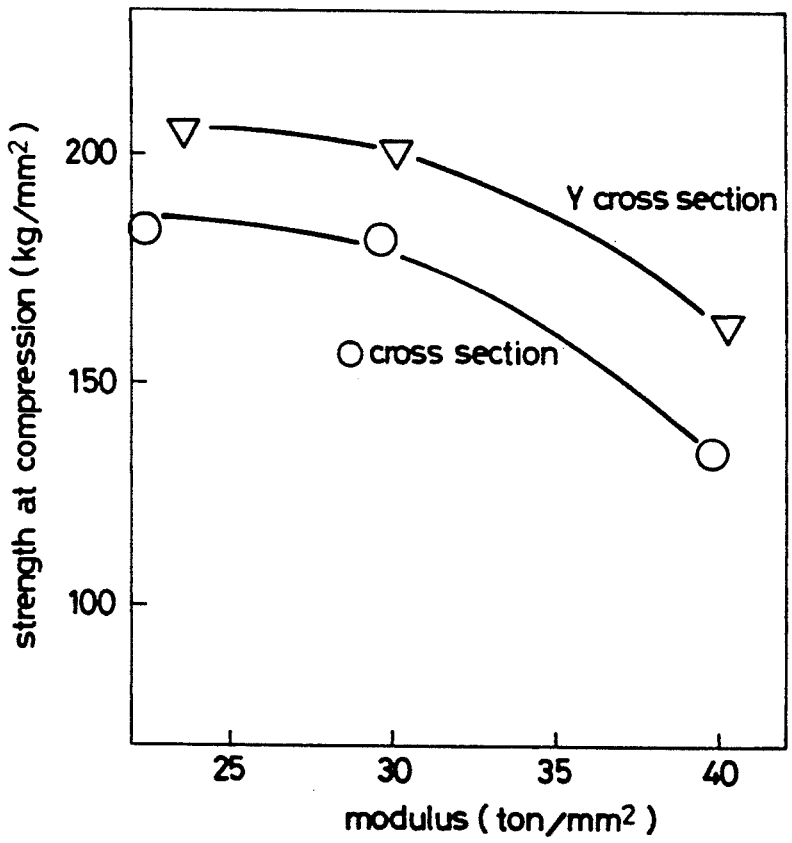
FIG. 5 is a diagram showing curves, each representing a relationship between the modulus of a resin-impregnated strand of a carbon fiber and the compressive strength of a composite.

Three circular cross-section carbon fibers of different modulus and three Y cross-section carbon fibers of different modulus were produced by varying and controlling the carbonization temperatures in Example 1 and Comparative Example 1. FIG. 5 shows the relationship between the modulus of the resin-impregnated strand and the compressive strength of the composite of each of the above carbon fibers.

As apparent from the figure, the noncircular cross-section carbon fiber of this invention shows a compressive strength exceeding that of the circular cross-section carbon fiber.

What is claimed is:

1. A noncircular cross-section carbon fiber, comprising a noncircular cross-section having at least one plane of symmetry passing its centroid and having an angle θ of rotational symmetry defined by $\theta = 360°/n$, in which n is an integer of 1 to 10; wherein an internal structure has no lamellar structure and said fiber has a substantially homogeneous crystalline structure; wherein a surface smoothness S of a fiber surface is 1.16 or below; and wherein a tensile strength and a tensile modulus of the carbon fiber in the form of a resin-impregnated strand are 300 kg/mm² or above and 20 ton/mm² or above, respectively.

2. A carbon fiber according to claim 1, wherein the value of n which defines the angle of rotational symmetry $\theta = 360°/n$ of the cross-section of the fiber is an integer of 1 to 5.

3. A carbon fiber according to claim 1, wherein a degree D of deformation defined by a ratio R/r, wherein R is the radius of the circumscribed circle of the cross-section of the fiber and r is the radius of the inscribed circle thereof, is 1.1 to 7.0.

4. A carbon fiber according to claim 1, wherein a degree D of deformation defined by a ratio R/r, wherein R is the radius of the circumscribed circle of the cross-section of the fiber and r is the radius of the inscribed circle thereof, is 1.2 to 6.0.

5. A carbon fiber according to claim 1, wherein the the tensile strength and the tensile modulus of the fiber in the form of a resin-impregnated strand is 320 kg/mm² or above and 22 ton/mm² or above, respectively.

6. A composite comprising the carbon fiber of claim 1 and a resin.

7. A process for producing a noncircular cross-section carbon fiber, comprising spinning a dope comprising an acrylonitrile polymer and an oxidation promoting vinyl monomer containing at least 95 mol % of acrylonitrile and a solvent for said polymer through a spinneret having noncircular cross-section holes temporarily into air or an inert gas atmosphere and immersing the spun dope in a coagulation bath comprising said solvent and a coagulant immediately after the spinning, followed by washing with water and drawing, thereby making fiber having a cross-section which is a noncircular one having at least one plane of symmetry passing its centroid and having an angle $\theta$ of rotational symmetry defined by $\theta = 360°/n$, wherein n is an integer of 1 to 10, oxidizing said fiber as a precursor, a fineness of the precursor being 0.3 to 1.5 denier, and carbonizing the oxidized precursor into a carbon fiber.

8. A process according to claim 7, wherein the acrylonitrile polymer is a copolymer comprising 98 mol % or above of acrylonitrile and 2 mol % or below of a vinyl monomer.

9. A process according to claim 7, wherein n which defines said angle $\theta$ of rotational symmetry of the cross-section of the fiber is an integer of 1 to 5.

10. A process according to claim 7, wherein a single-filament fineness of the precursor is 0.1 to 2.5 denier.

* * * * *